United States Patent [19]

Knight

[11] 4,111,579

[45] Sep. 5, 1978

[54] SCAFFOLDING

[75] Inventor: Stephen Vincent Knight, Maghull, England

[73] Assignee: North Western Scaffolding Company Limited, Liverpool, England

[21] Appl. No.: 782,371

[22] Filed: Mar. 29, 1977

[30] Foreign Application Priority Data

Apr. 2, 1976 [GB] United Kingdom ..... 13408/76

[51] Int. Cl.[2] ..... E04G 7/00

[52] U.S. Cl. ..... 403/387; 403/49; 182/179

[58] Field of Search ..... 403/387, 49, 385, 400, 403/398; 182/179, 178

[56] References Cited

U.S. PATENT DOCUMENTS 3,266,208 8/1966 Maggs et al. ..... 403/49 X

FOREIGN PATENT DOCUMENTS 533,802 11/1956 Canada ..... 403/49
1,091,472 10/1954 France ..... 403/400
406,603 8/1966 Switzerland ..... 403/400
523,297 7/1940 United Kingdom ..... 403/400

*Primary Examiner*—Andrew V. Kundrat
*Attorney, Agent, or Firm*—Charles E. Brown

[57] ABSTRACT

A scaffold fitting attached to a scaffold tube as a lever secured by a screw which passes through an intermediate aperture in the lever and which can be tightened to urge one end of the layer against a flanged member to clamp the latter directly against the scaffold tube.

8 Claims, 5 Drawing Figures

-FIG. 1-
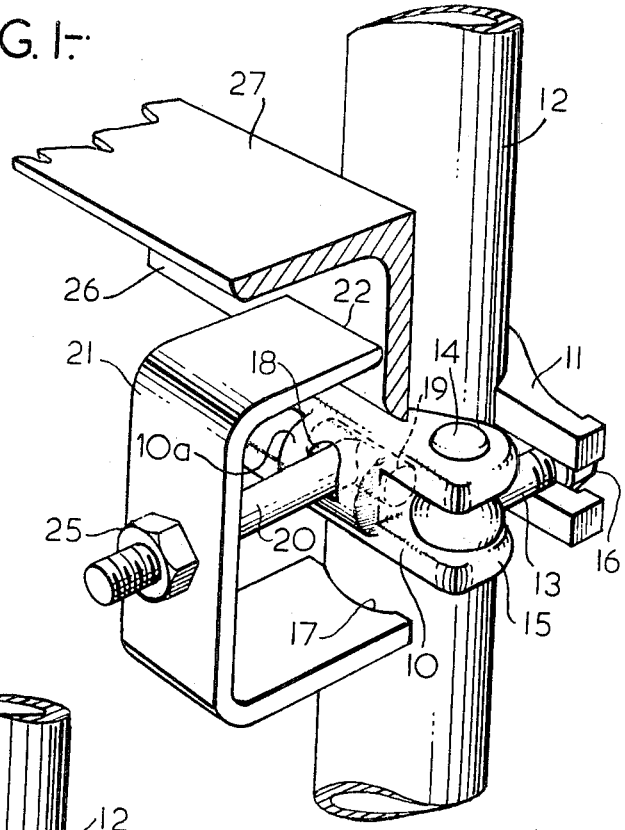
-FIG. 2-
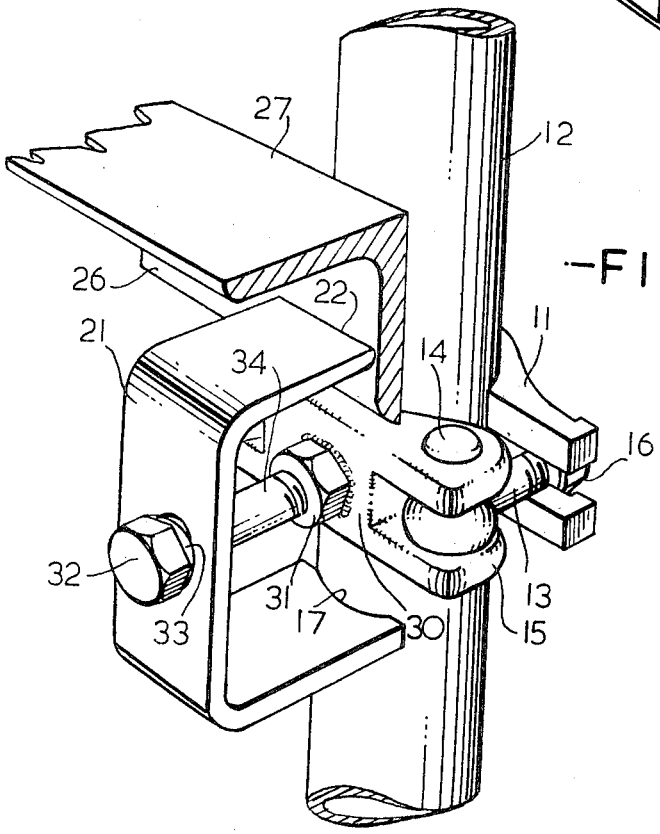

FIG. 3
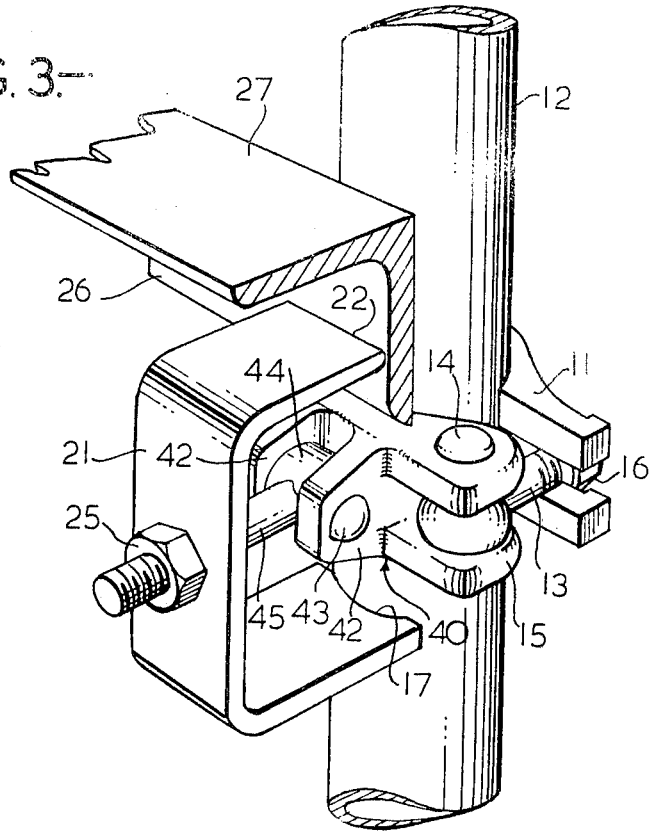
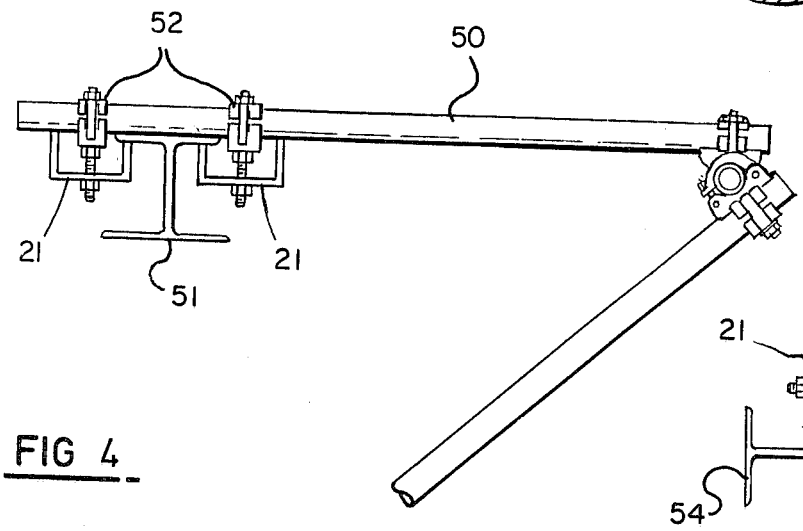
FIG 4
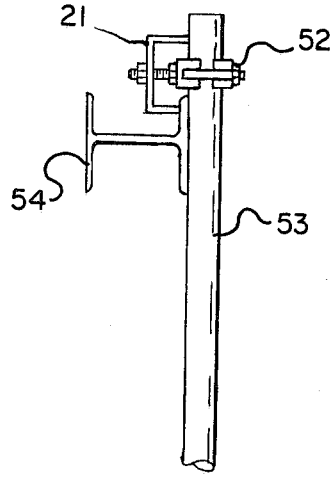
FIG 5

SCAFFOLDING

The present invention relates to scaffold fittings.

It is frequently desirable when erecting scaffolding to secure a scaffold tube to a joist or beam or vice versa and an object of the invention is to provide a clamp for this purpose although the clamp of the invention does have other uses.

According to the present invention, a clamp for clamping a scaffold tube to a flanged member or the like or vice versa comprises a body provided with means for securing the body to a scaffold tube and a lever provided with means for tightening the lever onto the body to enable a portion of the lever to clamp the flanged member or the like directly against the scaffold tube.

Preferably the last mentioned means comprises a screw and nut operative between the body and an intermediate portion of the lever.

In preferred embodiments, one free end of the lever is arranged to abut directly against the scaffold tube leaving the other end portion of the lever free to clamp the flanged member or the like directly against the scaffold tube.

In one alternative embodiment, the lever is pivoted by one end to the body to enable the other free end portion of the lever to clamp the flanged member or the like against the scaffold tube.

In another alternative embodiment, one end of the lever abuts the body leaving the other end portion free to clamp the flanged member or the like.

The means for securing the body to the scaffold tube can comprise any conventional type of scaffold clamp, such as a clamping jaw pivoted by one end to one end of the body and a screw and nut operative between the free end of the jaw and the other end of the body.

Advantageously the means for tightening the lever onto the body is aligned with the means for securing the body to the scaffold tube.

The invention is further described, by way of example, with reference to the accompanying drawings, in which:

FIG. 1 is an elevational view of one embodiment of a scaffold clamp according to the invention, FIGS. 2 and 3 are elevational views similar to FIG. 1 illustrating two other embodiments of scaffold clamp according to the invention; and FIGS. 4 and 5 are fragmentary sketches to illustrate two exemplary uses of the clamp according to the invention.

The scaffold clamp illustrated in FIG. 1 of the drawings comprises a body 10 to which is hinged a clamping jaw 11 to enable a scaffold tube 12 to be secured to the body 10. The jaw 11 is pivoted to the body 10 at the side of the body not visible in FIG. 1 and the free end of the jaw 11 is bifurcated to receive a clamping screw 13 in a conventional manner, as will be well understood by those familiar with the art. The head of the screw 13 is hinged to the side of the body 10 visible in FIG. 1 by a pin 14 received in lugs 15 integral with the body. A nut 16 can be tightened on the screw 13 to firmly secure the clamp to the scaffold tube 12 in conventional manner.

The body 10 and the clamping jaw 11 are preferably manufactured as steel forgings and the clamping lever 21 is preferably manufactured from bar stock.

A generally U-shaped clamping lever 21 has a central aperture through which passes a screw 20 whose head is pivotally retained on the body 10 as hereinafter described.

A nut 25 can be tightened on the screw 20 to clamp a flange 26 of a beam 27 between a clamping face 22 on one free end of the lever 21 and the scaffold tube 12. The other free end of the lever 21 has an arcuate abutment face 17 which rests against the scaffold tube 12.

The body 10 of the preferred embodiment is forged in such a way that it is provided with a centrally situated generally semi-cylindrical boss or protruberance 10*a*. The protruberance 10*a* of the body 10 has an aperture 18 which is somewhat larger than the diameter of the shank of the screw 20 and through which this shank passes. The screw 20 has a T-shaped head 19 which is received in a groove extending along the inside face of the body 10 inside the protruberance 10*a*. This groove is sufficiently deep to accommodate the T-shaped head 19 of the screw 20 without the T-shaped head binding against the scaffold tube 12. The screw 20 is thus free to swing to a limited extent in a longitudinal plane of the scaffold tube 12 and this facilitates the insertion of the flange 26 between the upper end of the lever 21 and the scaffold tube 12.

From FIG. 1 it can be seen that the screw 20 lies in the medial plane of the scaffold fitting, i.e. in a plane through the axis of the screw 13 and the not visible pivot between the body 10 and the jaw 11. In other words, the screw 20 for tightening the lever 21 relative to the body 10 is aligned with the means for securing the body 10 to the scaffold tube 12. In this way the loading on the means securing the fitting to the scaffold tube is no greater than the loading on the means for tightening the lever 21.

FIG. 1 of the drawings shows the two limbs of the lever 21 to be of substantially equal length so that the clamping force clamping the flange 26 against the scaffold tube 12 is only half of the tensional force in the screw 20. The clamping force can be increased relative to the tension in the screw 20 by making the lower arm of the lever provided with the abutment face 17 longer than the upper arm provided with the clamping face 22, the abutment and clamping faces being readily distinguishable because the former is arcuate and the latter is flat.

FIGS. 2, and 3 show modifications to the fitting and in these figures parts like those of FIG. 1 are denoted by like reference numerals.

In FIG. 2 a tapped boss 31 is formed integral with or welded to the body 30. In this embodiment the clamping screw 34 is screwed into the threaded boss 31 but cannot swing relative to the body 30. To give greater mobility the head 32 of the screw 34 is provided with a part-spherical seating 33 by which it abuts against the lever 21, the central aperture in this lever being somewhat larger than the bolt diameter to give substantial freedom for the lever 21 to tilt when the screw 20 is loosened.

In the embodiment of FIG. 3 of the drawings the body 40 is a forging in which lugs 42 are formed integral with the body. A pin 43 passes through a banjo head 44 of the screw 45 for tightening the lever 21. Alternatively, the lugs 42 can be welded to the body.

In the embodiments of FIGS. 1 and 3 the free end of the screw 20 or 45 can be deformed to keep the nut 25 and thereby the lever 21 captive on the fitting. Likewise, in the embodiment of FIG. 2 the inner end of the screw 34 can be deformed to prevent its complete removal from the body 30.

Whilst the beam 27 is shown as an angle section bar it could in fact be formed of any suitable section such as an H-section or an I-section but the clamp according to the invention has additional uses as described by way of example below.

FIG. 4 of the drawings shows the use of scaffold clamps according to the invention in the erection of cantilevered scaffolding. A horizontal scaffold tube or needle 50 is clamped to an I-beam 51 by two clamps 52 constructed according to the invention. It will be seen that the clamping levers 21 of the clamps 52 co-operate with the opposite upper flanges of the I-beam 51.

FIG. 5 of the drawings shows the use of clamps 52 according to the invention in the erection of suspended scaffolding. The upper end of a vertical tube 53 is clamped to a horizontal I-beam 44 by means of a clamp 52. The clamping lever 21 of the clamp 52 engages the upper right hand flange of the I-beam 54 which is arranged in this case with its web horizontal.

Another use of scaffold clamps according to the invention is for tying independent scaffolding to a steel framework of a building under construction. The horizontal tubes of the independent scaffolding can be readily secured to the flanges of the vertical columns or horizontal joists of the building frame.

Another use of the clamps according to the invention is to secure the vertical slideways of a temporary hoist to a scaffold framework. If such slideways comprise vertical H-beams or I-beams two flanges can be clamped to the framework leaving free the other two flanges upon which the hoist platform can be slidably guided.

Other exemplary uses are for attaching handrails formed by scaffold tubes or the like to a steel work structure and the securing of toe boards to the vertical tubes of a scaffold structure. In this case the upper edge of the toe board is clamped between the clamping lever and a scaffold tube.

It will be seen that in every case the member to be secured to a scaffold tube is clamped directly between a clamping face on one portion, preferably a free end, of a clamping lever and the scaffold tube itself.

I claim:

1. A scaffold fitting for clamping a scaffold tube to a flanged member or the like to vice versa comprising a body, means for detachably securing said body to a scaffold tube, a lever, and means aligned with said means for securing the body to the scaffold tube for tightening the lever onto the body to enable a portion of the lever to clamp the flanged member or the like directly against the scaffold tube without applying to the means for securing the body to the scaffold tube a load any greater than the load on the means for tightening the lever.

2. A scaffold fitting according to claim 1 in which said means for securing said body to the scaffold tube comprises a clamping jaw, means pivoting one end of said clamping jaw to one end of said body, and screw and nut means operative between an opposite free end of said jaw and the other end of said body.

3. A scaffold fitting according to claim 1 in which said tightening means comprises a screw and nut operative between said body and an intermediate portion of said lever.

4. A scaffold fitting according to claim 1 in which one free end of said lever is arranged to abut directly against the scaffold tube leaving the other end portion of said lever free to clamp the flanged member or the like directly against the scaffold tube.

5. A scaffold fitting according to claim 4 in which said one free end of said lever is curved to conform to the curvature of the scaffold tube.

6. A scaffold fitting for clamping a scaffold tube to a flanged member or the like or vice versa comprising a body, means for securing said body to a scaffold tube, a lever, and means for tightening the lever onto the body to enable a portion of the lever to clamp the flanged member or the like directly against the scaffold tube, said tightening means including a screw and nut operative between said body and an intermediate portion of said lever, said screw having a head by which it is hinged to said body to pivot in a plane extending longitudinally of the scaffold tube.

7. In a scaffolding system having scaffold tubes and at least one flanged member; a scaffold fitting for clamping a scaffold tube to said flanged member, said fitting comprising a body, means for securing said body to a scaffold tube, a lever having an intermediate aperture between opposite free ends thereof, a screw passing through said aperture in said lever, said body having an inner groove extending transversely to the scaffold tube and a hole communicating with said inner groove, said screw passing through said hole with clearance and having a head received in said groove whereby said screw is hinged to said body to pivot in a plane extending longitudinally of the scaffold tube, and a nut threaded on said screw to tighten said lever onto said body to enable one free end of said lever to abut directly against said scaffold tube and the other free end of said lever to abut said flanged member to clamp the latter directly against said scaffold tube.

8. A scaffold fitting according to claim 7 in which said body has a central semi-cylindriform protrusion, said groove being formed inside said protrusion and said hole being through said protrusion.

* * * * *